US011486069B2

(12) United States Patent
Lonati et al.

(10) Patent No.: US 11,486,069 B2
(45) Date of Patent: Nov. 1, 2022

(54) PROCESS FOR MANUFACTURING A TUBULAR INTARSIA KNITTED ITEM BY MEANS OF A CIRCULAR WEFT KNITTING MACHINE

(71) Applicant: SANTONI S.P.A., Brescia (IT)

(72) Inventors: Andrea Lonati, Brescia (IT); Mauro Alghisi, Torbole Casaglia (IT); Paolo Cristini, Brescia (IT)

(73) Assignee: SANTONI S.P.A., Brescia (IT)

( * ) Notice: Subject to any disclaimer, the term of this patent is extended or adjusted under 35 U.S.C. 154(b) by 0 days.

(21) Appl. No.: 17/273,415

(22) PCT Filed: Sep. 19, 2019

(86) PCT No.: PCT/IB2019/057933
§ 371 (c)(1),
(2) Date: Mar. 4, 2021

(87) PCT Pub. No.: WO2020/065464
PCT Pub. Date: Apr. 2, 2020

(65) Prior Publication Data

US 2021/0238782 A1 Aug. 5, 2021

(30) Foreign Application Priority Data

Sep. 26, 2018 (IT) ..... 102018000008947

(51) Int. Cl.
*D04B 9/36* (2006.01)
*D04B 1/02* (2006.01)
(Continued)

(52) U.S. Cl.
CPC ..... *D04B 9/36* (2013.01); *D04B 1/02* (2013.01); *D04B 1/104* (2013.01); *D04B 1/108* (2013.01);
(Continued)

(58) Field of Classification Search
CPC ... D04B 1/26; D04B 7/32; D04B 9/46; D04B 9/54; A43B 1/04
See application file for complete search history.

(56) References Cited

U.S. PATENT DOCUMENTS 3,259,915 A * 7/1966 Dison ..... A41B 11/005 D2/980
3,796,067 A * 3/1974 East ..... D04B 1/26 66/178 R
(Continued)

OTHER PUBLICATIONS

Search Report dated Jan. 3, 2020 in corresponding International Application No. PCT/IB2019/057933, 5 pages.
(Continued)

*Primary Examiner* — Danny Worrell
(74) *Attorney, Agent, or Firm* — MH2 Technology Law Group LLP

(57) ABSTRACT

A process for manufacturing a tubular knitted item (1) with intarsia design, comprising the steps of:

programming a circular weft knitting machine for intarsia design by defining a tubular intarsia knitted item (1) to be manufactured, extending longitudinally between a first end (2) and a second end (3) and consisting of a plurality of knitted courses following one another;

wherein the programming step comprises the steps of:

defining a turning position (4), which divides the tubular item into a first fabric (5) and a second fabric (6), wherein the tubular item is configured for being manipulated so as to be at least partially turned over itself, by folding it in the turning position so that the second fabric overlaps the first fabric in order to obtain a double fabric item;

defining at least one first area (10) of the first fabric, delimited by a needle section and by a number of successive courses of the area, and having a desired shape;

(Continued)

defining at least one first counter-area (20) of the second fabric, delimited by a needle section and by a number of successive courses of the area, in which the first counter-area has a respective shape;

producing intarsia knitted fabric so as to manufacture the tubular knitted item according to the programming step; wherein the first area (10) is manufactured according to a first knitted structure and the first counter-area (20) is manufactured according to a second knitted structure.

20 Claims, 3 Drawing Sheets

(51) Int. Cl.

| | |
|---|---|
| ***D04B 1/10*** | (2006.01) |
| ***D04B 1/12*** | (2006.01) |
| ***D04B 1/24*** | (2006.01) |
| ***D04B 9/12*** | (2006.01) |

(52) U.S. Cl.

CPC ..... *D04B 1/126* (2013.01); *D04B 1/24* (2013.01); *D04B 9/12* (2013.01); *D10B 2403/023* (2013.01); *D10B 2501/043* (2013.01)

(56) References Cited

U.S. PATENT DOCUMENTS

| | | | | | |
|---|---|---|---|---|---|
| 4,341,096 | A | | 7/1982 | Safrit et al. | |
| 4,373,215 | A | * | 2/1983 | Guigley | D04B 1/26 2/239 |
| 4,467,626 | A | * | 8/1984 | Coble | A41B 11/02 66/196 |
| 4,571,960 | A | * | 2/1986 | Hursh | A41B 11/005 66/196 |
| 4,615,188 | A | * | 10/1986 | Hursh | A41B 11/02 66/196 |
| 4,843,844 | A | * | 7/1989 | Hursh | A41B 11/005 66/196 |
| 4,958,507 | A | * | 9/1990 | Allaire | D04B 9/54 66/185 |
| 5,226,194 | A | * | 7/1993 | Staley | A41B 11/005 66/178 R |
| 5,675,992 | A | * | 10/1997 | Wrightenberry | A41B 11/005 66/178 R |
| 5,778,702 | A | * | 7/1998 | Wrightenberry | A41B 11/005 66/178 R |
| 6,862,902 | B1 | * | 3/2005 | Kim | A41B 11/005 66/196 |
| 6,931,762 | B1 | * | 8/2005 | Dua | A43B 23/042 66/185 |
| 8,959,959 | B1 | | 2/2015 | Podhajny | |
| 10,499,701 | B2 | * | 12/2019 | Cai | A43B 23/042 |
| 2003/0033837 | A1 | * | 2/2003 | Higgins | A41B 11/005 66/178 R |
| 2003/0089136 | A1 | | 5/2003 | Lynch et al. | |
| 2012/0266362 | A1 | * | 10/2012 | Craig | D04B 1/26 66/185 |
| 2015/0107307 | A1 | * | 4/2015 | Kosui | A43B 1/04 2/239 |
| 2017/0208900 | A1 | | 7/2017 | Boucher et al. | |
| 2018/0168271 | A1 | | 6/2018 | Ly | |
| 2018/0235318 | A1 | | 8/2018 | Terai et al. | |

OTHER PUBLICATIONS

Written Opinion dated Jan. 3, 2020 in corresponding International Application No. PCT/IB2019/057933, 15 pages.

* cited by examiner

PROCESS FOR MANUFACTURING A TUBULAR INTARSIA KNITTED ITEM BY MEANS OF A CIRCULAR WEFT KNITTING MACHINE

CROSS-REFERENCE TO RELATED APPLICATIONS

This application is a U.S. National Stage application of PCT/IB2019/057933 filed Sep. 19, 2019, pending, which claims priority to Italian Patent Application No. 102018000008947, filed Sep. 26, 2018, the entire disclosures of which are hereby incorporated by reference in their entireties.

FIELD OF THE INVENTION

The present invention relates to a process for manufacturing a tubular knitted item with intarsia design by means of a circular weft or warp knitting machine. The present invention further relates to a shoe upper made with a tubular knitted item obtained by means of said process.

In particular, the present invention concerns an "intarsia" design made on a circular weft knitting machine so as to obtain a tubular knitted item, which after suitable handling has a double or multiple fabric, e.g. for manufacturing a shoe upper.

BACKGROUND OF THE INVENTION

It is known about the use of circular weft knitting machines for manufacturing tubular items designed for a shoe upper. Such tubular items, once manufactured by the knitting machine, typically undergo a series of operations, such as cutting, sewing, application of additional portions, etc., in order to obtain an upper apt to be suitably associated with a sole for making a shoe.

It is also known, when manufacturing an upper obtained by means of a circular weft knitting machine, about manufacturing a tubular knitted item which, at the end of the process, has a "double fabric", i.e. consists of two different overlapping layers or cloths of fabric, where a cloth represents an inner fabric while the other cloth represents an outer fabric of the upper. To this purpose the tubular knitted item is produced starting from a first end, which will then represent the toe of the inner fabric (or of the outer fabric), and is manufactured on its whole length as far a second end, which will then represent the toe of the outer fabric (or of the inner fabric). The tubular knitted item thus manufactured therefore has on its whole length development the inner fabric followed, in a continuous manner, by the outer fabric (or vice versa, the outer fabric followed by the inner fabric). After being manufactured on the machine, the tubular knitted item is suitably manipulated so as to partially turn it on itself, folding the outer fabric (starting e.g. from the second end) over the inner fabric (towards the first end), until two overlapping fabrics (an inner fabric and an outer fabric) and thus a double fabric upper are obtained. It is evident that, in the middle or in another intermediate area of the tubular knitted item (placed between the first and second end), the outer fabric is turned over the inner fabric, and the resulting, double fabric upper thus develops between a front edge or border, in which the first and second end overlap, of the original tubular knitted item, and a rear edge or border, corresponding to the folding circumference of the outer fabric over the inner fabric.

SUMMARY

In the framework of the production of double fabric uppers by means of circular knitting machines as the ones disclosed above, the Applicant has identified the presence of some drawbacks.

First of all, the Applicant has observed that known, double fabric uppers exhibit a structure that is not able to impart specific technical and functional characteristics to the upper itself.

The Applicant has further observed that known processes for manufacturing double fabric uppers by means of circular knitting machine enable only a limited number of possible structures for the tubular knitted item making the upper, which limits the results that can be obtained.

Under these circumstances, an aim underlying the present invention, in its various aspects and/or embodiments, is to propose a process for manufacturing a tubular intarsia knitted item, with a circular weft knitting machine, that is able to solve the problems disclosed above and to overcome the limitations of known techniques.

In particular, an aim of the present invention is to propose a process for manufacturing a tubular intarsia knitted item from which a double fabric, or multiple fabric, upper can be obtained, with specific structural characteristics that can impart given technical properties to the upper itself. In further detail, an aim of the present invention is to propose a process that allows to manufacture a tubular knitted item from which an upper with specific characteristics of comfort and wearability can be obtained.

A further aim of the present invention is to propose a process for manufacturing a tubular intarsia knitted item that enables to create a large number of differentiated structures, in particular so as to obtain a wide variety of possible double or multiple layer uppers.

A further aim of the present invention is to propose a process that enables to manufacture upper shoes in an economically competitive manner.

A further aim of the present invention is to create alternative solutions to the prior art for manufacturing tubular knitted items with intarsia designs and double or multi-layer uppers, and/or to open new design possibilities.

These and other possible aims, which shall appear better from the following description, are basically achieved by a process for manufacturing a tubular knitted item with intarsia design and by a shoe upper manufactured with a tubular knitted item obtained by means of this process, according to one or more of the appended claims and according to the following aspects and/or embodiments, variously combined, possibly also with the aforesaid claims.

In a first aspect, the invention relates to a process for manufacturing a tubular knitted item with intarsia design by means of a circular weft or warp knitting machine.

In the present description and in the claims attached thereto, the wording "intarsia design", as known in the field of knitwear, relates to a design made up of alternating knitted areas obtained with yarns supplied by one or more feeds of the machine, which does not have floating yarns on the reverse side, i.e. yarns connecting portions of the same knitted course that are at a distance from one another and obtained with their own yarn, and which does not have yarn cutting or trimming at the ends of each course portion making up a design area. By way of summary, "intarsia" designs are textile designs with motives, colors and knitted patterns differentiated in the various areas of the item, which do not exhibit trimmed yarns and/or can avoid the presence of floating yarns.

In the present invention and in the claims attached thereto, a fabric "area" is any portion or zone of the item included in a given group or section of adjacent needles for a given number of knitted courses. In other words, each area has a longitudinal development, i.e. along a direction of development corresponding to the forward movement of the fabric being formed, for a given number of courses, and a lateral development, i.e. in a direction orthogonal to the longitudinal development (and corresponding to the development of the needlebed), for a given number of needles, which may also vary for each course involved in the area. Each area can have any shape, with given profiles and size along a direction of development of the fabric (longitudinally) and along the direction of the knitted course (laterally); each area is therefore characterized by a given knitted pattern and by special yarns being used.

Intarsia designs can be made with rectilinear or circular knitting machines for knitwear or hosiery items enabling to move the feeds on which the yarns are supplied with respect to the needle-holding organ, the latter consisting either of a rectilinear needlebed or of a cylinder, or vice versa, i.e. enabling to move the needle-holding organ with respect to the feeds, according to two directions of motion opposed to one another, i.e. with a forward motion and with a backward motion (processing with alternating motion).

Generally, intarsia designs are made, when manufacturing each knitted course making up the intarsia design, by correlating and actuating the needles arranged in a section of the needle-holding organ to a feed and correlating and actuating the needles arranged in another, adjacent or neighboring, section of the needle-holding organ to another feed. The number of feeds and sections of the needle-holding organ correlated thereto varies according to the number of different areas of the design to be obtained and, as disclosed above, the number of needles of each section of the needle-holding section can be varied for each course so as to vary the shape of the different areas of the intarsia design to be obtained.

The alternating motion of the needle-holding organ with respect to the feeds of the machine enables to process portions of knitted courses with yarns supplied by different feeds without cutting the yarns at the end of the corresponding portion of knitted course or without letting floating on the reverse the yarns that are not used for processing a successive portion of knitted course and waiting to be used again for forming a further portion of knitted course.

The connection of two adjacent areas of the design, processed with yarns supplied on two different feeds, is preferably obtained by actuating at least one needle, located on the boundary between the sections and belonging to either of these sections, both on the feed correlated to its groups of needles and on the feed correlated to the adjacent or neighboring group of needles.

Generally, intarsia designs are used for obtaining knitted patterns and motives consisting of areas of knitted fabric manufactured with yarns of different color or type, which are supplied to different feeds.

Some aspects of the invention are listed below.

In one aspect, the process for manufacturing a tubular knitted item with intarsia design by means of a circular weft knitting machine, comprises the steps of:

arranging a circular weft knitting machine for intarsia designs, i.e. knitted designs with motifs, colors and knitted patterns differentiated in the various knitted areas, though without floating yarns on the reverse, the knitting machine having at least one feed and a needle-holding organ supporting a plurality of needles, which define a needlebed and can be actuated so as to take the yarns supplied by said feed and form a knitted fabric; said needle-holding organ being turnable with respect to said feed and said feed being arranged near said needle-holding organ; said needle-holding organ to be actuated with an alternating rotary motion with respect to said feed, i.e. with two opposite directions of movement, a forward and a backward movement, respectively, so as to make the needles face said feed one after the other and form a knitted fabric both in the forward and in the backward movement of said needle-holding organ with respect to said feed;

programming said knitting machine so as to define a tubular intarsia knitted item to be manufactured, extending longitudinally in a continuous manner between a first end and a second end and consisting of a plurality of knitted courses following one another.

In one aspect, said step of programming said knitting machine comprises the step of defining, on a given knitted course, or several knitted courses, in intermediate position between the first end and the second end, at least one turning position, wherein the knitted fabric between the first end and the turning position represents a first fabric of the tubular knitted item and the knitted fabric between the turning position and the second end represents a second fabric of the tubular knitted item, and wherein the tubular knitted item is configured for being manipulated so as to turn it at least partially over itself, folding it on said turning position so that the second fabric overlaps at least partially the first fabric, shifting said second end towards the first end, so as to obtain at least a double fabric item with the second fabric at least partially wound outside the first fabric.

In one aspect, said step of programming said knitting machine comprises the step of defining at least one first area belonging to said first fabric, said first area being delimited laterally, i.e. in a direction corresponding to the development of the needlebed, inside a needle section, comprising a given number of adjacent needles, and being delimited longitudinally, i.e. along a direction of development corresponding to the forward movement of the fabric being formed, by a given number of successive courses of the area, wherein the width of said needle section may vary for each course of said successive courses of the area, so that the first area has a desired shape.

In one aspect, the process comprises the step of producing intarsia knitted fabric with the circular knitting machine so as to manufacture said tubular intarsia knitted item according with the aforesaid programming step.

In one aspect, the step of producing intarsia knitted fabric comprises the step of manufacturing said first area according to a first knitted structure.

In one aspect, said step of programming said knitting machine comprises the step of defining at least one first counter-area belonging to said second fabric, said first counter-area being delimited laterally inside a respective needle section, and being delimited longitudinally by a respective given number of successive courses of the area, wherein the width of said needle section may vary for each course of said successive courses of the counter-area, so that the first counter-area has a respective desired shape.

In one aspect, the step of producing intarsia knitted fabric comprises the step of manufacturing said first counter-area according to a second knitted structure.

In one aspect, said first knitted structure is a terrycloth knitted fabric.

In one aspect, said second knitted structure is a knitted fabric obtained by actuating the needles according to one or more, or according to a combination, of the following technical ways:

non-operating needle;

withdrawn needle;

unloaded needle.

In one aspect, said second knitted structure is an openwork knitted fabric.

In one aspect, said second knitted structure is a terrycloth knitted fabric.

In one aspect, said first knitted structure is an openwork knitted fabric.

In one possible embodiment, the first and second knitted structures can be inverted, i.e. the step of manufacturing intarsia knitted fabric comprises the steps of:

manufacturing said first area according to the second knitted structure;

manufacturing said first counter-area according to the first knitted structure.

In one aspect, said terrycloth knitted fabric can be:

full terrycloth, i.e. a terrycloth knitted fabric manufactured by making a terrycloth stitch for each needle; and/or half terrycloth, i.e. a terrycloth knitted fabric manufactured by alternating terrycloth stitches and non-terrycloth stitches; and/or terrycloth with motifs, i.e. a terrycloth knitted fabric manufactured so as to obtain given shapes or texts.

In one aspect, in said defining steps, the first area and the first counter-area can be defined in any portions of the tubular knitted item, of the first fabric and of the second fabric, respectively.

In one aspect, the first counter-area has a shape basically corresponding and mirror-like with respect to the shape of said first area.

In one aspect, the shape of the first area and the respective shape of the first counter-area are symmetrical to one another with respect to said turning position.

In one aspect, the first counter-area of the second fabric is designed to be at least partially facing or overlapping the corresponding first area of the first fabric when the tubular knitted item is turned over itself in said turning position so as to obtain at least a double fabric item.

In one aspect, the first counter-area can correspond to the whole second fabric, said respective needle section laterally delimiting the first counter-area comprising all the active needles of said needle-holding organ, and said respective given number of successive courses longitudinally delimiting the first counter-area comprising all the courses between the turning position and the second end of the tubular knitted item.

In one aspect, said first area and said first counter-area are defined in such positions of the tubular knitted item that, after turning the item over itself, by folding it in said turning position so that the second fabric at least partially overlaps the first fabric, thus obtaining at least a double fabric item, the first area and the first counter-area are:

in a first functional position designed to be the part of a shoe tongue, i.e. the shoe fabric stripe placed over the instep, preferably under the laces; or in a second functional position designed to be the rear part of a shoe, i.e. the part housing the foot heel; or in a third functional position designed to be a part of a shoe insole, on which the foot plant rests, i.e. the part housing the foot heel.

In one aspect, the tubular knitted item has an outer side and an inner side.

In one aspect, said step of programming said knitting machine comprises the steps of:

defining a second area belonging to said first fabric, distinct from said first area, said second area being delimited laterally, i.e. in a direction corresponding to the development of the needlebed, inside a respective needle section, comprising a given number of adjacent needles, and being delimited longitudinally, i.e. along a direction of development corresponding to the forward movement of the fabric being formed, by a respective given number of successive courses of the area, wherein the width of said needle section may vary for each course of said successive courses of the area, so that the second area has a desired shape;

defining a second counter-area belonging to said second fabric, distinct from said first counter-area, said second counter-area being delimited laterally inside a respective needle section, and being delimited longitudinally by a respective given number of successive courses of the area, wherein the width of said needle section may vary for each course of said successive courses of the counter-area, so that the second counter-area has a shape basically corresponding and mirror-like with respect to the shape of said second area, and so that the shape of the second area and the shape of the second counter-area are symmetrical to one another with respect to said turning position; said second counter-area of the second fabric is designed to be facing or overlapping the corresponding second area of the first fabric when the tubular knitted item is turned over itself in said turning position so as to obtain at least a double fabric item.

In one aspect, said second area and said second counter-area are defined in such positions of the tubular knitted item that, after turning the item over itself, by folding it in said turning position so that the second fabric at least partially overlaps the first fabric, thus obtaining at least a double fabric item, the second area and the second counter-area are in a further functional position designed to be a part of a shoe upper.

In one aspect, in the step of programming said knitting machine a plurality of areas and corresponding counter-areas are defined, wherein each area and each counter-area exhibit the same technical characteristics described for said first area and said first counter-area, and wherein each area and each counter-area are designed to be, as a result of the item being turned over itself and of obtaining at least a double fabric item, in a respective functional area.

Preferably, the following areas are defined:

an area and a corresponding counter-area for said first functional position; and/or an area and a corresponding counter-area for said second functional position; and/or an area and a corresponding counter-area for said third functional position; and/or an area and a corresponding counter-area for said further functional position.

In one aspect, in the step of manufacturing intarsia knitted fabric, the tubular knitted item is manufactured starting from said first end to said second end actuating for each knitted course given needle sections of the needle-holding organ with given feeds of the knitting machine, based on the definition of said areas and said counter-areas of the tubular knitted item.

In one aspect, said turning position is a closed path, e.g. a circumference, defined on the tubular knitted item, and preferably corresponds to a circular knitted course.

In one aspect, said step of programming said knitting machine comprises the step of defining, on a given knitted course, or several knitted courses, in intermediate position between the first end or the second end and said turning position, a further turning position in which the tubular knitted item is configured to be further turned at least partially over itself, so as to define a third fabric at least partially overlapping the first or the second fabric, in order to obtain a triple fabric item.

In one aspect, the third fabric, included between said further turning position and said first or second end, is manufactured—in each of its knitted courses—with a given needle section of the needle-holding organ only, thus being shaped as a stripe of fabric and not as a tubular fabric.

In one aspect, said step of programming said knitting machine comprises the step of defining, on given knitted courses, in intermediate position between the first end and the second end, a plurality of turning positions in which the tubular knitted item is configured to be turned over itself, so as to define a plurality of overlapping fabrics in order to obtain a multiple fabric item.

In one aspect, the process comprises a step of folding said second fabric, in said turning position, on the first fabric, so that the item is a double fabric item and represents a shoe upper developing between a front edge, in which the first end and the second end of the tubular knitted item overlap, and a rear edge, corresponding to said turning position, wherein said front edge is configured for being closed so as to represent the toe of the upper and of the shoe thereof, and said rear edge is designed to receive the user's foot inserted into it.

In one aspect, the step of folding said second fabric on the first fabric comprises a manipulating step of the tubular knitted item that causes the insertion of the first fabric into the second fabric, the second fabric overlapping the first fabric, so that as a result the inner sides of the first fabric and of the second fabric, as manufactured by the knitting machine, face each other in contact inside the double fabric item, and the outer side of the second fabric, as manufactured by the knitting machine, is visible outside the double fabric item and the outer side of the first fabric, as manufactured by the knitting machine, represents the inside of the double fabric item.

In one alternative aspect, the aforesaid folding step takes place with inverted parts, as far as the first fabric and the second fabric are concerned, with respect to the preceding aspect.

In one aspect, the process comprises a step of closing, e.g. by sewing or bonding, said front edge, and in particular the first end and/or the second end of the folded tubular knitted item, in order to manufacture an upper.

In one independent aspect thereof, the present invention relates to a shoe upper manufactured with a tubular knitted item obtained by means of the aforesaid process, wherein said second fabric of the tubular knitted item is folded, in said turning position, on the first fabric of the tubular knitted item, so that the shoe upper is double fabric and develops between a front edge, in which the first end and the second end of the tubular knitted item overlap, and a rear edge, corresponding to said turning position, wherein said front edge is configured for being closed so as to represent the toe of the upper and of the shoe thereof, and said rear edge is designed to receive the user's foot inserted into it.

Further characteristics and advantages will be more evident from the detailed description of a preferred, though not exclusive, embodiment of a process for manufacturing a tubular knitted item with intarsia design by means of a circular weft or warp knitting machine, and a shoe upper with double or multiple layer according to the present invention.

DESCRIPTION OF THE DRAWINGS

This description shall be made below with reference to the accompanying drawings, provided to a merely indicative and therefore non-limiting purpose, in which.

DETAILED DESCRIPTION

With reference to the figures mentioned, the numeral 1 globally designates a tubular knitted item with intarsia design manufactured with a process according to the present invention.

In order to execute the process according to the present invention, a weft knitting machine with at least one feed and with a needle-holding organ supporting a plurality of needles, defining a needle bed, which can be actuated in a per se known manner in order to take the yarns supplied by this feed and form a fabric, is preferably used. The needle-holding organ can be rotated with respect to the feed and the feed is arranged near the needle-holding organ. The needle-holding organ can be actuated in a per se known manner with an alternating rotary motion with respect to the feed, i.e. according to two directions of motion opposed to one another, a forward and a backward motion, respectively, so as to make the needles in sequence face the feed and form a fabric both in the forward motion and in the backward motion of the needle-holding organ with respect to the feed, as requested in intarsia designs.

From the point of view of knitting technology, the structure of the whole knitting machine and the operation of the needle-holding organ (e.g. the cooperation between needles and yarns, etc.) are not described in detail since they are known in the technical field of the present invention.

Figure 1:
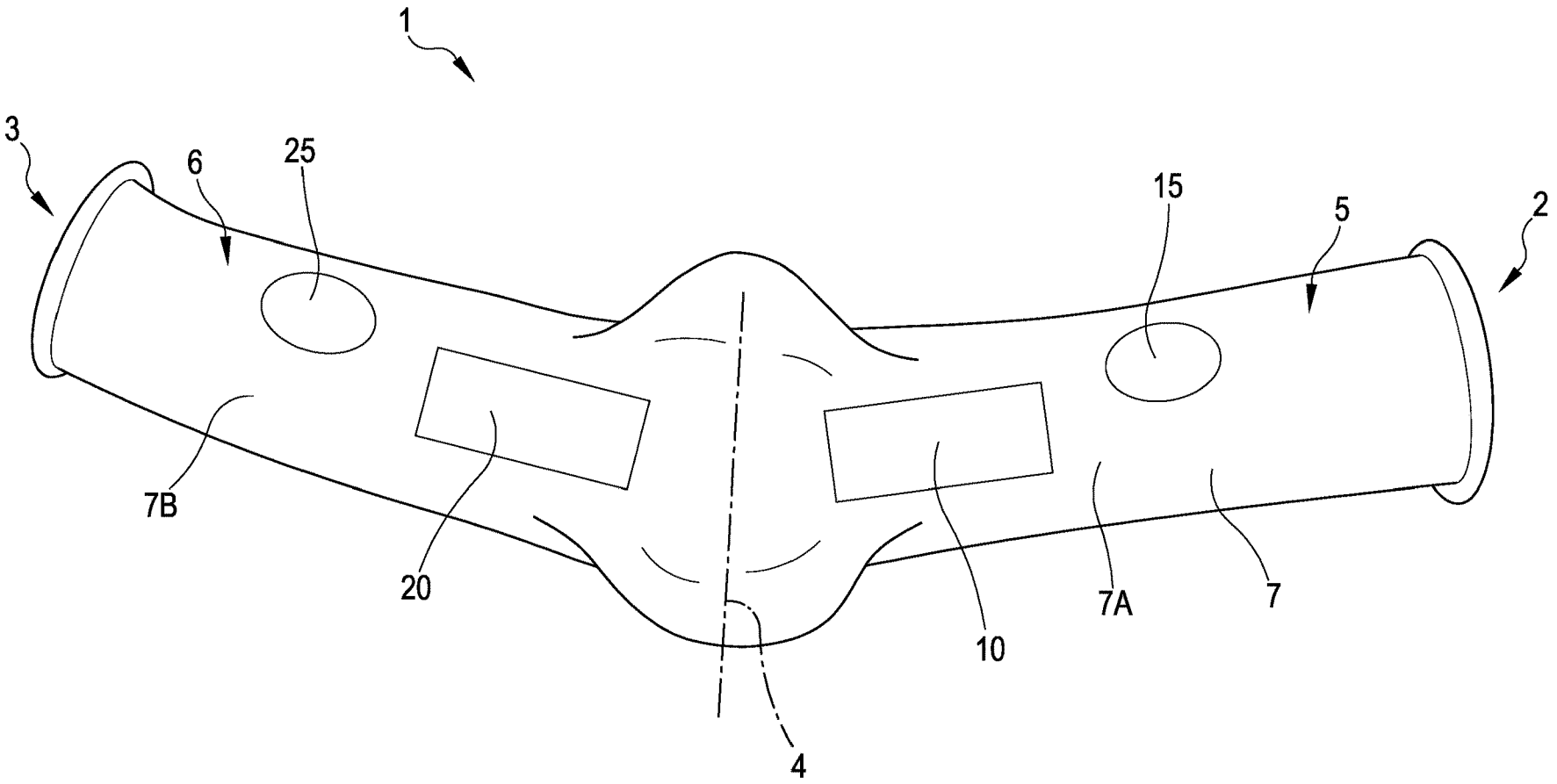
FIG. 1 schematically shows by way of example a tubular knitted item with intarsia design manufactured by means of the process according to the present invention.

The process of the present invention comprises a step of programming the knitting machine so as to define a tubular intarsia knitted item 1 to be manufactured, which extends longitudinally in a continuous manner between a first end 2 and a second end 3 and consists of a plurality of knitted courses following one another. An example of tubular item 1 is schematically shown in FIG. 1.

The step of programming the knitting machine comprises at least one step of defining at least one turning position 4, on a given knitted course, or several knitted courses, in intermediate position between the first end 2 and the second end 3; the knitted fabric between the first end 2 and the turning position 4 represents a first fabric 5 of the tubular knitted item 1 and the knitted fabric between the turning position 4 and the second end 3 represents a second fabric 6 of the tubular knitted item 1.

Figure 2:
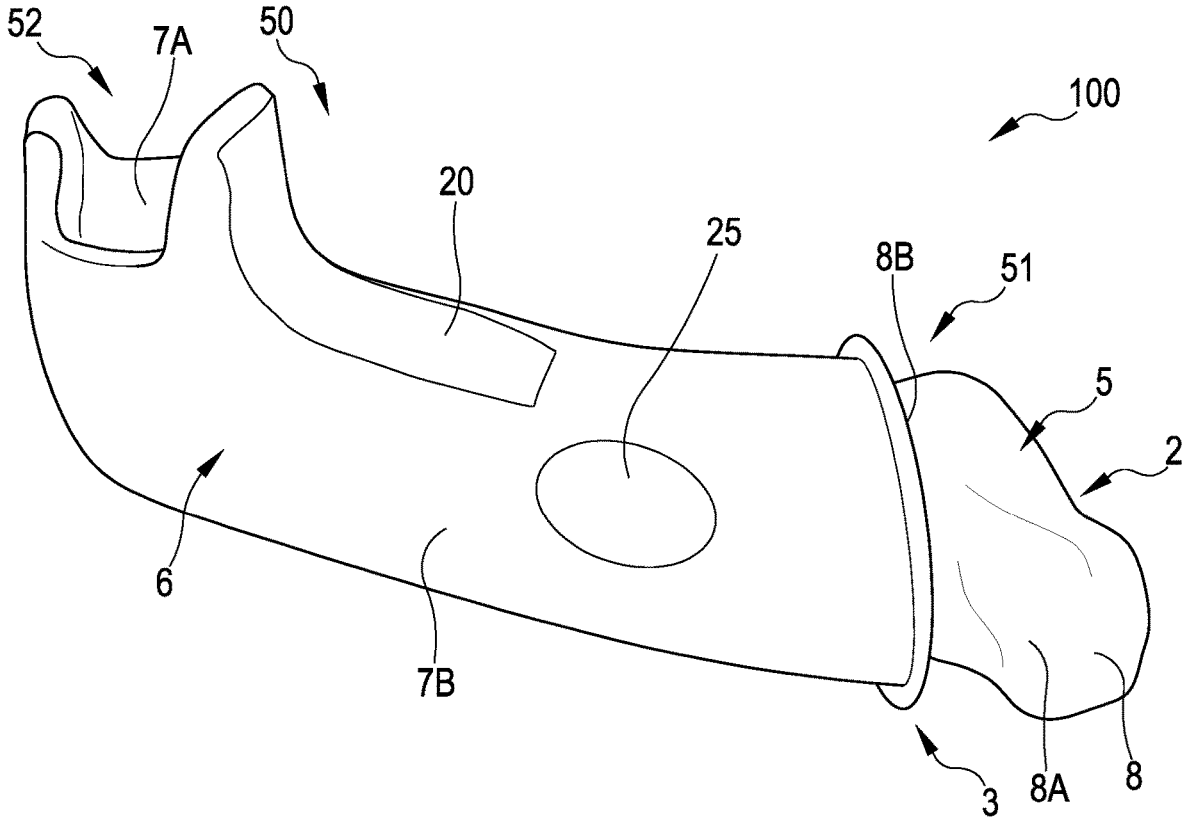
FIG. 2 schematically shows a tubular knitted item of the type as in FIG. 1, partially turned over itself so as to obtain a double fabric item, so as to manufacture a shoe upper.

The tubular knitted item 1 is therefore configured for being manipulated so as to turn it at least partially over itself, folding it in the turning position 4 so that the second fabric 6 overlaps at least partially the first fabric 5, shifting the second end 3 towards the first end 2, so as to obtain a double fabric item 100 with the second fabric at least partially wound outside the first fabric. The result of manipulating the tubular knitted item 1 and of folding the two fabrics 5 and 6 is shown in FIG. 2, which schematically shows the resulting double fabric item 100. Conversely, as an alternative and in an equivalent manner, the manipulation can be executed so that the first fabric 5 at least partially overlaps the second fabric 6, shifting the first end towards the second end, so as to obtain a double fabric item 100 with the first fabric at least partially wound outside the second fabric.

The step of programming the knitting machine comprises the step of defining at least one first area 10 belonging to the first fabric 5; this first area 10 is delimited laterally, i.e. in a direction corresponding to the development of the needlebed, inside a needle section, comprising a given number of adjacent needles, and is delimited longitudinally, i.e. along a direction of development corresponding to the forward movement of the fabric being formed, by a given number of successive courses of the area; the width of the needle section may vary for each course of the successive courses of the area 10, so that the first area has a desired shape, i.e. any shape.

The process further comprises the step of producing intarsia knitted fabric with the circular knitting machine so as to manufacture the tubular intarsia knitted item 1 according with the aforesaid programming step.

In its turn, the step of producing intarsia knitted fabric comprises the step of manufacturing the first area 10 according to a first knitted structure.

Basically, the process first includes defining in the tubular item at least the two longitudinal item portions that will represent the first fabric and the second fabric; this definition of the two fabrics takes place by means of a "separation line" consisting of the turning position.

The step of programming the knitting machine can further comprise a step of defining at least one first counter-area 20 belonging to the second fabric 6; this first counter-area 20 is delimited laterally inside a respective needle section and is delimited longitudinally by a respective given number of successive courses of the area; the width of the needle section may vary for each course of the aforesaid respective successive courses of the counter-area; thus the first counter-area 20 has a respective desired shape.

The step of producing intarsia knitted fabric therefore comprises the step of manufacturing the first counter-area 20 according to a second knitted structure.

Preferably, the first counter-area 20 can have a shape basically corresponding and mirror-like with respect to the shape of the first area 10.

Preferably, the shape of the first area 10 and the shape of the first counter-area 20 can be symmetrical to one another with respect to the turning position 4.

According to a possible preferred, though not exclusive, embodiment, the first counter-area 20 of the second fabric 6 is designed to be at least partially facing or overlapping the corresponding first area 10 of the first fabric 5 when the tubular knitted item 1 is turned over itself in the turning position 4 so as to obtain a double fabric item 100. The first area 10 and the first counter-area 20 can be totally or partially overlapping.

In a possible embodiment, the first counter-area 20 can correspond to the whole second fabric 6; in this case, the respective needle section laterally delimiting the first counter-area 20 comprises all the active needles of the needle-holding organ, and the respective given number of successive courses longitudinally delimiting the first counter-area comprises all the courses between the turning position 4 and the second end 3 of the tubular knitted item.

An example of first area 10 and of first counter-area 20 can be seen in FIG. 1, in this case with their shapes corresponding to and mirror-like with respect to the turning position.

It should be observed that the area 10 and the counter-area 20 are portions of the knitted item, each being delimited by a given section of adjacent needles for a given number of knitted courses; basically, they represent a geometrical portion of the fabric, or an area, whose shape is defined by the needles concerned for the courses involved. For each course involved in the area, a given needle section takes part to the formation of said area.

In a possible embodiment, the first fabric and the second fabric can be inverted, i.e. the knitted fabric between the first end and the turning position represents the second fabric of the tubular knitted item and the knitted fabric between the turning position and the second end represents the first fabric of the tubular knitted fabric; in this case, when the tubular knitted item is manipulated so as to be turned at least partially over itself, by folding it in the turning position, the first fabric at least partially overlaps the second fabric, shifting the second end towards the first end, so as to obtain at least a double fabric item with the first fabric at least partially wound outside the second fabric.

The definition of the first and of the second end of the tubular knitted item, and of the first and second fabric, can take place as a function of the characteristics to be obtained on the double fabric item (which will then be the shoe upper) as a result of the turning operations.

It should be observed that the folding operation, as a result of which a fabric overlaps the other or a fabric is inserted into the other, preferably occurs so that as a result the inner sides of the first and second fabric (i.e. the inside of the item not yet folded) get in contact with each other inside the "double fabric", whereas the outer side of the first fabric is visible outside the double fabric item (and vice versa the outer side of the second fabric represents the inside of the double fabric item).

Preferably, the aforesaid first knitted structure is a terrycloth knitted fabric.

Preferably, the aforesaid second knitted structure is a knitted fabric obtained by actuating the needles according to one or more of the following technical ways:

non-operating needle;
withdrawn needle;
unloaded needle.

As an alternative, the second knitted structure is an openwork knitted fabric.

Still as an alternative, the second knitted structure is a terrycloth knitted fabric.

In a further embodiment of the process, the aforesaid first knitted structure is an openwork knitted fabric.

In this embodiment, the second knitted structure is a knitted fabric obtained by actuating the needles according to one or more of the following technical ways:

non-operating needle;
withdrawn needle;
unloaded needle.

As an alternative, the second knitted structure is a terrycloth knitted fabric.

Still as an alternative, the second knitted structure is an openwork knitted fabric.

Basically, the first and second knitted structure can be chosen at will among terrycloth, openwork or a combination of the technical ways of weft knitting.

In one further possible embodiment, the first and second knitted structures can be inverted, i.e. the step of manufacturing intarsia knitted fabric comprises the steps of:

- manufacturing the first area according to the second knitted structure;
- manufacturing the first counter-area according to the first knitted structure.

Preferably, the aforesaid terrycloth knitted fabric can be:

- a full terrycloth, i.e. a terrycloth knitted fabric manufactured by making a terrycloth stitch for each needle; and/or
- a half terrycloth, i.e. a terrycloth knitted fabric manufactured by alternating terrycloth stitches and non-terrycloth stitches; and/or
- a terrycloth with motifs, i.e. a terrycloth knitted fabric manufactured so as to obtain given shapes or texts.

Preferably, according to the process, in the aforesaid defining steps, the first area 10 and the first counter-area 20 can be defined in any portions of the tubular knitted item 1, of the first fabric 5 and of the second fabric 6, respectively (or vice versa).

Preferably, the first area 10 and the first counter-area 20 are defined in such positions of the tubular knitted item 1 that, after turning the item over itself, by folding it in the turning position 4 so that the second fabric at least partially overlaps the first fabric, thus obtaining at least a double fabric item 100, the first area 10 and the first counter-area 20 are:

- in a first functional position designed to be the part of a shoe tongue, i.e. the shoe fabric stripe placed over the instep, preferably under the laces; or
- in a second functional position designed to be the rear part of a shoe, i.e. the part housing the foot heel; or
- in a third functional position designed to be a part of a shoe insole, on which the foot plant rests, i.e. the part housing the foot base.

It should be observed that, in the embodiment shown by way of example in FIGS. 1 and 2, the first area 10 and the second counter-area 20 are defined in the aforesaid first functional position, i.e. they represent the part of the shoe tongue placed over the instep.

The Applicant has observed that the possibility of defining at will the first area and the first counter-area, and of assigning a particular knitted structure to it, allows to impart given technical characteristics to the different areas of the double fabric knitted item 100 once it has been obtained by folding the tubular item 1. Advantageously, by considering e.g. a shoe upper, the possibility of placing a portion of terrycloth knitted fabric in a given areas allows to impart to this area a "cushioning" function, which can be useful e.g. in the tongue area, where the laces of the upper press against the instep, or in the heel areas, where as is known shoes can cause redness on the user's foot, or also in the area of the foot plant, so as to reduce the impact shock which the foot is subjected to when hitting the ground.

By way of example, if the first knitted structure selected is a terrycloth knitted fabric (and therefore the first area of the first fabric is made of terrycloth), and the second knitted structure consists of a combination of the aforesaid three technical way or is an openwork knitted fabric, in the double fabric tubular item 100 a single fabric terrycloth is obtained, which enables a given cushioning level. For instance, in the first counter-area of the second fabric a more elastic knitted fabric can be obtained (with given stitches or yarn types), by combining in the double fabric item the characteristics of absorption and comfort/softness (imparted by terrycloth) with the elastic properties (obtained with the technical ways).

Still by way of example, the same design can however be selected for the first and the second knitted structure. For instance, the first area can be made of terrycloth (on the first fabric) and the first counter-area also of terrycloth (on the second fabric), with a better shock absorption and comfort effect.

In a possible embodiment, the possibility of placing a portion of openwork knitted fabric in a given area allows to impart to this areas a "perspiration" function, which can be useful for instance, in the case of an upper or a garment, for improving air circulation and letting warm air and moisture outside the upper or the garment.

By way of example, if the first knitted structure selected is a terrycloth knitted fabric (and therefore the first area of the first fabric is made of terrycloth), and the second knitted structure is an openwork knitted fabric, in the double fabric tubular item 100 a combination of the characteristics of absorption and comfort/softness (imparted by terrycloth) with the perspiration properties (obtained with openwork) is obtained.

Still by way of example, by selecting the openwork knitted design for the first knitted structure (on the first fabric) and for the second knitted structure (on the second fabric), area and respective counter-area are both obtained in openwork, and thus a double fabric item that is fully perspiring in a given portion.

It should be observed that the aforesaid three technical ways, corresponding to actuating the needles in non-operating position, withdrawn or dropped, enable to obtain particular knitted structures in the areas and counter-areas, and therefore to impart a higher stiffness, or vice versa a higher elasticity, in given portion of the item thus obtained. The use of the three technical ways occurs in combination with the terrycloth and openwork knitted structures; for instance, as disclosed above, a counter-area (then overlapping the corresponding areas) with a given knitted structure (e.g. stiffer or more elastic) can be coupled to a terrycloth areas, with properties of softness, using the three technical ways: for instance, by actuating the needles in "non-operating" mode the fabric produced can be tightened in a given area or counter-area.

It is therefore evident that the process of the present invention enables to obtain precise technical effects on the double fabric item thus manufactured, and in particular to impart specific technical characteristics to given portions of the item.

The tubular knitted item 1 according to the present invention exhibits an outer side 7 and an inner side 8.

Preferably, in the step of defining at least one first area 10 belonging to the first fabric 5, this first area 10 is defined on the inner side 8 of the tubular knitted item 1.

Preferably, in the step of defining at least one first counter-area 20 belonging to the second fabric 6, this first counter-area 20 is defined on the inner side 8 of the tubular knitted item 1.

Preferably, based on the characteristics desired for the tubular item to be manufactured, the step of programming the knitting machine can comprise the steps of:

defining a second area 15 belonging to the first fabric 5, distinct from the first area 10, said second area 15 being delimited laterally, i.e. in a direction corresponding to the development of the needlebed, inside a respective needle section, comprising a given number of adjacent needles, and being delimited longitudinally, i.e. along a direction of development corresponding to the forward movement of the fabric being formed, by a respective given number of successive courses of the area, wherein the width of the needle section may vary for each course of said successive courses of the area, so that the second area 15 has a desired shape, i.e. any shape;

defining a second counter-area 25 belonging to the second fabric 6, distinct from the first counter-area 20; the second counter-area 25 is delimited laterally inside a respective needle section, and is delimited longitudinally by a respective given number of successive courses of the area, wherein the width of the needle section may vary for each course of successive courses of the counter-area, so that the second counter-area 25 has a shape basically corresponding and mirror-like with respect to the shape of the second area 15, and so that the shape of the second area and the shape of the second counter-area are symmetrical to one another with respect to the turning position 4; the second counter-area 25 of the second fabric 6 is designed to be facing or overlapping the corresponding second area of the first fabric when the tubular knitted item is turned over itself in the turning position so as to obtain a double fabric item 100.

The second area 15 and the second counter-area 25 are defined in such positions of the tubular knitted item 1 that, after turning the item over itself, by folding it in the turning position 4 so that the second fabric at least partially overlaps the first fabric, thus obtaining a double fabric item 100, the second area 15 and the second counter-area 25 are in a further functional position designed to be a part of a shoe upper.

Preferably, in the step of defining the second area 15 belonging to the first fabric 5, this second area 15 is defined on the inner side 8 of the tubular knitted item 1.

Preferably, in the step of defining the second counter-area 25 belonging to the second fabric 6, this second counter-area 25 is defined on the inner side 8 of the tubular knitted item 1.

In FIGS. 1 and 2, for convenience's sake, the areas and counter-areas are identified also on the outer side 7.

Preferably, in possible embodiments, in the step of programming the knitting machine a plurality of areas and corresponding counter-areas are defined, wherein each area and each counter-area exhibit the same technical characteristics described for said first area and said first counter-area, and wherein each area and each counter-area are designed to be, as a result of the item being turned over itself and of obtaining at least a double fabric item, in a respective functional area.

Preferably, the following areas are defined:

an area and a corresponding counter-area for the aforesaid first functional position; and/or an area and a corresponding counter-area for the aforesaid second functional position; and/or an area and a corresponding counter-area for the aforesaid third functional position; and/or an area and a corresponding counter-area for the aforesaid further functional position.

Preferably, in the step of manufacturing intarsia knitted fabric, the tubular knitted item is manufactured starting from the first end 2 to the second end 3 actuating for each knitted course given needle sections of the needle-holding organ with given feeds of the knitting machine, based on the definition of the areas and counter-areas of the tubular knitted item 1.

Preferably, the turning position 4 is a closed path, e.g. a circumference, defined on the tubular knitted item 1, and preferably corresponds to a circular knitted course.

Preferably, each one of the areas and counter-areas defined on the tubular knitted item has a respective perimeter or contour defining the respective shape. Preferably, this perimeter or contour is closed and uninterrupted.

In the example shown in FIG. 1, the first areas 10 and the first counter-area 20 have a rectangular shape, whereas the second area 15 and the second counter-areas 25 have an oval shape.

Preferably, the first area and the second area can share together one or more knitted courses, on respective different needle sections. Preferably, the first counter-area and the second counter-area can share together one or more knitted courses, on respective different needle sections. In other words, the same knitted course can comprise needles (and corresponding stitches) belonging to sections of different areas (or counter-areas). The first area and the second area can be adjacent or partially neighboring, i.e. they can share a part of the respective perimeter, and similarly, the first counter-area and the second counter-area can be adjacent or partially neighboring, i.e. share a part of the respective perimeter. Preferably, adjacent areas can be neighboring but not intersecting. Similarly, adjacent counter-areas can be neighboring but not intersecting.

In a possible embodiment, not shown, the step of programming the knitting machine comprises the step of defining, on a given knitted course, or several knitted courses, in intermediate position between the first end or the second end and the turning position, a further turning position in which the tubular knitted item is configured to be further turned at least partially over itself, so as to define a third fabric at least partially overlapping the first or the second fabric, in order to obtain a triple fabric item.

Preferably, the third fabric can be manufactured with a yarn configured for melting with the underlying first or second fabric after applying heat and/or pressure.

In a possible embodiment, the third fabric, included between the further turning position and the first or the second end, can be manufactured in each of its knitted courses with a given needle section of the needle-holding organ only, thus being shaped as a strip of fabric and not as a tubular fabric. Preferably, in this case the further turning position has a segment- or arc-like shape.

An example of this embodiment is a fabric cover for the tongue, i.e. a fabric starting from the further turning position and having a stripe-like shape. This stripe is thus folded over said further turning position and becomes a further portion covering the tongue area. The fabric stripe can also be suitably shaped by increasing and/or decreasing the operating needles.

In a possible embodiment, the step of manufacturing intarsia knitted fabric includes manufacturing the first area with a first yarn and the first counter-area with a second yarn, wherein the first yarn and the second yarn differ as far as composition, color and/or technical characteristics are concerned.

In a possible embodiment, the step of manufacturing intarsia knitted fabric includes manufacturing the first area and the first counter-area with the same type of yarn.

In a possible embodiment, the first knitted structure is a terrycloth knitted fabric, or an openwork knitted fabric, and the second knitted structure is made with a stiff yarn or an elastic yarn.

In a further embodiment, the step of programming said knitting machine comprises the step of defining, on given knitted courses, in intermediate position between the first end and the second end, a plurality of turning positions in which the tubular knitted item is configured to be turned over itself, so as to define a plurality of overlapping fabrics in order to obtain a multiple fabric item.

Preferably, the process provides that by folding the second fabric 6 in the turning position 4 over the first fabric 5 a double fabric item 100 is obtained, which represents an upper 50 for a shoe. This upper develops between a front edge 51, in which the first end 2 and the second end 3 of the original tubular knitted item 1 overlap, and a rear edge 52, basically corresponding to the turning position 4. The front edge 51 is configured for being closed so as to represent the toe of the upper and of the show, whereas the rear edge 52 is designed to receive the user's foot inserted into it.

In the configuration of the double fabric item 100 as a shoe upper 50, shown by way of example in FIG. 2, the first fabric 5 represents the inner fabric of the upper, whereas the second fabric 6 represents the outer fabric of the upper. Moreover, the outer part of the first fabric (considering the original machine production of the tubular knitted item 1) becomes the part in contact with the user's foot, whereas the outer part of the second fabric is visible outside the upper.

In other words, the folding of the second fabric on the first fabric is obtained by manipulating the tubular knitted item, which causes the insertion of the first fabric into the second fabric, the second fabric overlapping the first fabric, so that as a result the inner sides 8A and 8B of the first fabric 5 and of the second fabric 6, respectively, as manufactured by the knitting machine, face each other in contact inside the double fabric item, and the outer side 7B of the second fabric, as manufactured by the knitting machine, is visible outside the double fabric item and the outer side 7A of the first fabric 5, as manufactured by the knitting machine, represents the inside of the double fabric item.

It should be noted that the resulting double fabric upper 50 has outside the outer side of the second fabric and inside the outer side of the first fabric. This is obtained without floating and/or trimmed yarns since the item is manufactured with an intarsia design.

The process can comprise a step of closing, e.g. by sewing or bonding, the front edge 51, and in particular the first end 2 and/or the second end 3 of the folded tubular knitted item, in order to manufacture an upper 50.

Preferably, though not necessarily, the circular weft knitting machine for intarsia design used for implementing the process of the present invention, can have the following technical characteristics:

- several feeds, preferably 4 feeds;
- selection of sinkers for each feed;
- possibility of manufacturing terrycloth knitted fabric, in each feed and for each needle, in both movements of the needle-holding organ, i.e. both in the forward and in the backward movement;
- possibility of manufacturing openwork knitted fabric, in each feed and for each needle, in both movements of the needle-holding organ, i.e. both in the forward and in the backward movement.

Preferably, each feed can deliver at least one respective yarn, in a given color and/or material, irrespective of the respective yarns of the remaining feeds.

Preferably, each feed has a plurality of yarn feeders, so that it can deliver a plurality of different yarns. For instance, it is possible to have at least four different colors and therefore manufacture terrycloth knitted fabric simultaneously with four or more different colors on the same course.

Figure 3:
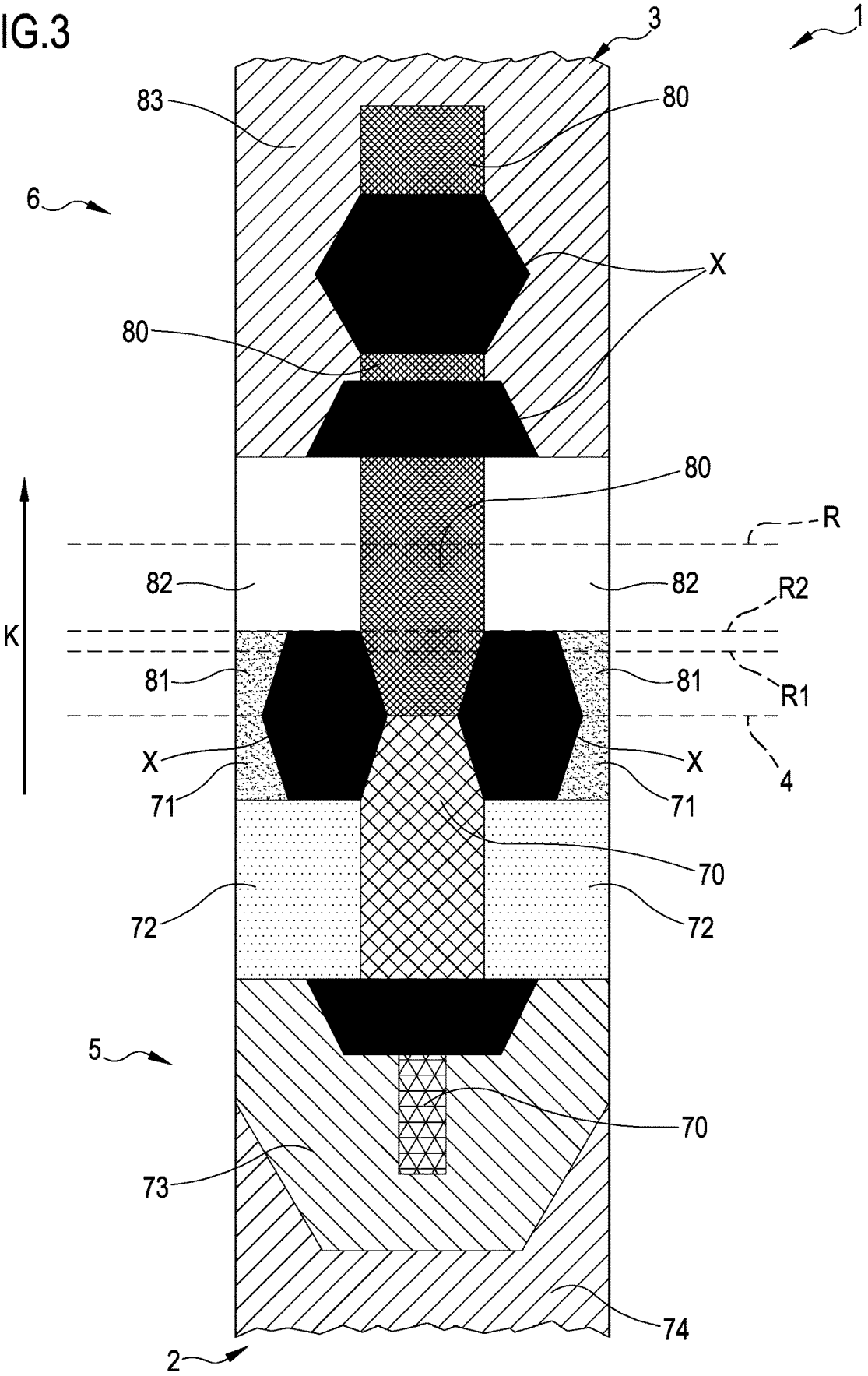
FIG. 3 schematically shows by way of example the graphic representation of a processing program to be executed on a circular weft knitting machine so as to implement the process according to the present invention and manufacture a tubular intarsia knitted item according to the present invention.

The graphical representation of FIG. 3 is disclosed below: it schematically shows an example of a processing program to be executed on a circular weft knitting machine so as to implement the process according to the present invention and manufacture a tubular intarsia knitted item.

First of all, the representation shows the tubular item 1 stretched as if it had been cut along a longitudinal axis, corresponding to the fabric manufacturing direction (indicated by arrow K), and therefore open; each horizontal line corresponds to a knitted course (line R indicates by way of example one course). The turning position 4 divides the item into the first fabric 5 and the second fabric 6. It should be observed that, by way of example, the representation of FIG. 3 can also correspond to one longitudinal portion of the tubular item only, which can then continue with further knitted courses on both ends 2 and 3. For instance, the tubular item can be manufactured by the knitting machine in a continuous manner, and then be divided by cutting into several tubular items 1.

Moreover, in FIG. 3 a series of areas and counter-areas (all of them by way of example), included in the item, can be observed, as indicated by numerals 70, 71, 72, 73, 74 and 80, 81, 82 and 83: according to the description and to the technical features of intarsia designs, several different areas or counter-areas can be defined inside the same course. For instance, the course R (remember that the representation shows the tubular item "cut" and open) is shared by the counter-areas 80 and 82 fully occupying it; in the course R each needle produces fabric and two boundary lines shared by the perimeter of the shapes of the counter-areas 80 and 82 are present.

Black areas (indicated with X) represent needle sections which, in given knitted courses, are non-operating: this is possible thanks to the knitting features of an intarsia machine, which allows to interrupt stitch formation on given selected needles, and to resume it later. The shape of the black areas can be obtained by progressively resuming or excluding working on the needles in several successive courses. It should be observed that black areas do not result in "holes" in the tubular item, but represent sections of needles that do not produce fabric: this means that, where a black area is present, the adjacent areas are however in contact with each other so as to ensure continuity in stitch formation, but in the courses containing black areas less stitches are formed, which result in section tightening. Let us consider e.g. FIG. 3, in the course referred to with R1 two needle sections are excluded from stitch formation, whereas all the needles resume fabric production on the course R2, shared by the counter-areas 80 and 82. The area 70 and the counter-area 80 are interrupted for a few knitted courses, in which fabric is produced only on the sides, but at the end of the working process they have however a closed and uninterrupted shape. Therefore, several areas in each course can be started and ended, without cutting or trimming yarn; the stitch, at the boundary between an area and the adjacent one, is always connected with another stitch.

The exclusion of given needle sections, which creates the black areas of FIG. 3, enables to give a three-dimensional shape to the tubular item, i.e. to create pockets, bulges and "protrusions" in the tubular item, which thus is not perfectly cylindrical in its whole longitudinal extension but has a precise shape that after folding will allow to obtain a double fabric item with a particular shape. For instance, the black areas of FIG. 3, adjacent to the areas 70 and 71 and to the counter-areas 80 and 81, allow to obtain the bulges schematically shown in FIG. 1 in the portion of the item adjacent to the turning position 4. These bulges are precisely designed and programmed so as to obtain a correct shape of the upper 50 once the tubular item 1 has been folded.

The invention achieves important advantages.

First of all, the invention allows to overcome the drawbacks of prior art.

In particular, the invention allows to manufacture a tubular knitted item from which a double fabric, or multiple fabric, knitted item can be obtained, with specific structural characteristics that can impart given technical properties to the item itself.

Moreover, the invention allows to manufacture a tubular knitted item from which a double fabric, or multiple fabric, item, and in particular an upper, can be obtained, with specific characteristics in terms of comfort, wearability, cushioning or shock absorption, and/or perspiration. The knitted item that can be obtained with the process of the present invention may have any structure and is stable and durable.

As disclosed above, the process of the present invention enables to obtain precise technical effects on the double fabric item thus manufactured, and in particular to impart specific technical characteristics to given portions of the item. For instance, the process of the present invention allows to place terrycloth or openwork knitted fabric in specific areas of the textile item (and in particular of a double fabric upper). The areas, especially those with terrycloth fabric, are positioned with an intarsia design and this operation can be made at will also for course portions (and not necessarily for whole courses), without trimmed and/or floating yarns.

The present invention therefore enables to obtain tubular intarsia knitted items with large number of differentiated structures; in particular, a wide variety of possible double or multiple layer uppers can be obtained.

The process of the present invention allows to manufacture shoe uppers with high structural features and in an economically competitive manner.

The invention claimed is:

1. A process for manufacturing a tubular intarsia knitted item (1) with intarsia design by means of a circular weft knitting machine, comprising the steps of:

arranging a circular weft knitting machine for intarsia designs, with motifs, colors and knitted patterns differentiated in the various knitted areas, though without trimmed or floating yarns on the reverse, the knitting machine having at least one feed and a needle-holding organ supporting a plurality of needles, which define a needlebed and are actuated so as to take the yarns supplied by said feed and form a knitted fabric; said needle-holding organ being turnable with respect to said feed and said feed being arranged near said needle-holding organ; said needle-holding organ to be actuated with an alternating rotary motion with respect to said feed, said alternating rotary motion comprising a forward movement and a backward movement, so as to make the needles face said feed one after the other and form a knitted fabric both in the forward movement and in the backward movement of said needle-holding organ with respect to said feed; and programming said knitting machine so as to define a tubular intarsia knitted item (1) to be manufactured, extending longitudinally in a continuous manner between a first end (2) and a second end (3) and consisting of a plurality of knitted courses following one another;

wherein said step of programming said knitting machine comprises the steps of:

defining, on a given knitted course, or several knitted courses, in intermediate position between the first end (2) and the second end (3), at least one turning position (4), wherein the knitted fabric between the first end (2) and the turning position (4) represents a first fabric (5) of the tubular intarsia knitted item (1) and the knitted fabric between the turning position (4) and the second end (3) represents a second fabric (6) of the tubular intarsia knitted item (1), and wherein the tubular intarsia knitted item (1) is configured for being manipulated so as to turn it at least partially over itself, folding it on said turning position (4) so that the second fabric (6) overlaps at least partially the first fabric (5), shifting said second end (3) towards the first end (2), so as to obtain at least a double fabric item (100) with the second fabric (6) at least partially wound outside the first fabric (5);

defining at least one first area (10) belonging to said first fabric (5), said first area (10) being delimited laterally, in a direction corresponding to the development of the needlebed, inside a needle section, comprising a given number of adjacent needles, and being delimited longitudinally, along a direction of development corresponding to the forward movement of the fabric being formed, by a given number of successive courses of the area, wherein the width of said needle section is selectively variable for each course of said successive courses of the area, so that the first area (10) has a desired shape; and producing intarsia knitted fabric with said circular knitting machine so as to manufacture said tubular intarsia knitted item (1) according with the aforesaid programming step;

wherein the step of producing intarsia knitted fabric comprises the step of manufacturing said first area (10) according to a first knitted structure.

2. The process according to claim 1, wherein said step of programming said knitting machine comprises the step of:

defining at least one first counter-area (20) belonging to said second fabric (6), said first counter-area (20) being delimited laterally inside a respective needle section, and being delimited longitudinally by a respective given number of successive courses of the area, wherein the width of said needle section is selectively variable for each course of said successive courses of the counter-area, so that the first counter-area (20) has a respective desired shape;

and wherein the step of producing intarsia knitted fabric comprises the step of manufacturing said first counter-area (20) according to a second knitted structure.

3. The process according to claim 1, wherein said first knitted structure is a terrycloth knitted fabric, and wherein said second knitted structure is a knitted fabric manufactured by actuating the needles according to a combination of the following technical modes:

non-operating needle;

withdrawn needle; and unloaded needle.

4. The process according to claim 1, wherein said first knitted structure is a terrycloth knitted fabric, and wherein said second knitted structure is an openwork knitted fabric or a terrycloth knitted fabric.

5. The process according to claim 1, wherein said first knitted structure is an openwork knitted fabric, and wherein said second knitted structure is a knitted fabric manufactured by actuating the needles according to a combination of the following technical modes:

non-operating needle;

withdrawn needle; and unloaded needle.

6. The process according to claim 1, wherein said first knitted structure is an openwork knitted fabric, and wherein said second knitted structure is a terrycloth knitted fabric or an openwork knitted fabric.

7. The process according to claim 3, wherein said terrycloth knitted fabric is:

full terrycloth, comprising a terrycloth knitted fabric manufactured by making a terrycloth stitch for each needle; or half terrycloth, comprising a terrycloth knitted fabric manufactured by alternating terrycloth stitches and non-terrycloth stitches; or terrycloth with motifs, comprising a terrycloth knitted fabric manufactured so as to obtain given shapes or texts, and wherein, in said defining steps, the first area (10) and the first counter-area (20) are defined in any portions of the tubular intarsia knitted item (1), of the first fabric (5) and of the second fabric (6), respectively.

8. The process according to claim 2, wherein said at least one first counter-area (20) has a shape corresponding to the shape of said first area (10), and wherein the shape of the first area (10) and the shape of the first counter-area (20) are symmetrical to one another with respect to said turning position (4), or wherein said first counter-area (20) of the second fabric (6) is designed to be at least partially facing or overlapping the corresponding first area (10) of the first fabric (5) when the tubular intarsia knitted item (1) is turned over itself in said turning position (4) so as to obtain at least a double fabric item (100).

9. The process according to claim 1, wherein said first area (10) and said first counter-area (20) are defined in such positions of the tubular knitted intarsia item (1) that, after turning the item over itself, by folding it in said turning position (4) so that the second fabric (6) at least partially overlaps the first fabric (5), thus obtaining at least a double fabric item, the first area and the first counter-area are:

in a first functional position designed to be the part of a shoe tongue, comprising the shoe fabric stripe placed over the instep; or in a second functional position designed to be the rear part of a shoe, comprising the part housing the foot heel; or in a third functional position designed to be a part of a shoe insole, on which the foot plant rests, comprising the part housing the foot base.

10. The process according to claim 1, wherein the tubular intarsia knitted item has an outer side (7) and an inner side (8), and wherein:

in said step of defining at least one first area (10) belonging to said first fabric (5), said first area (10) is defined on the inner side (8) of the tubular intarsia knitted item (1), and in said step of defining at least one first counter-area (20) belonging to said second fabric (6), said first counter-area (20) is defined on the inner side (8) of the tubular intarsia knitted item (1).

11. The process according to claim 1, wherein said step of programming said knitting machine comprises the steps of:

defining a second area (15) belonging to said first fabric (5), distinct from said first area (10), said second area (15) being delimited laterally, in a direction corresponding to the development of the needlebed, inside a respective needle section, comprising a given number of adjacent needles, and being delimited longitudinally, along a direction of development corresponding to the forward movement of the fabric being formed, by a respective given number of successive courses of the area, wherein the width of said needle section is selectively variable for each course of said successive courses of the area, so that the second area (15) has a desired shape; and defining a second counter-area (25) belonging to said second fabric (6), distinct from said first counter-area (20), said second counter-area (25) being delimited laterally inside a respective needle section, and being delimited longitudinally by a respective given number of successive courses of the area, wherein the width of said needle section is selectively variable for each course of said successive courses of the counter-area, so that the second counter-area (25) has a shape corresponding to the shape of said second area (15), so that the shape of the second area (15) and the shape of the second counter-area (25) are symmetrical to one another with respect to said turning position (4), and/or wherein said second counter-area (25) of the second fabric (6) is designed to be at least partially facing or overlapping the corresponding second area (15) of the first fabric (5) when the tubular knitted item (1) is turned over itself in said turning position (4) so as to obtain at least a double fabric item, and wherein said second area (15) and said second counter-area (25) are defined in such positions of the tubular knitted intarsia item (1) that, after turning the item over itself, by folding it in said turning position (4) so that the second fabric (6) at least partially overlaps the first fabric (5), thus obtaining at least a double fabric item, the second area (15) and the second counter-area (25) are in a further functional position designed to be a part of a shoe upper.

12. The process according to claim 1, wherein in the step of manufacturing intarsia knitted fabric, the tubular intarsia knitted item (1) is manufactured starting from said first end (2) to said second end (3) actuating for each knitted course given needle sections of the needle-holding organ with given feeds of the knitting machine, based on the definition of said areas and said counter-areas of the tubular intarsia knitted item, and wherein said turning position (4) is a closed path, e.g. a circumference, defined on the tubular intarsia knitted item.

13. The process according to claim 1, wherein each of said areas (10; 15) and said counter-areas (20; 25) defined on the tubular intarsia knitted item (1) has a respective perimeter or contour defining the respective shape, and wherein this perimeter or contour is closed and without interruptions, or wherein said first area (10) and said second area (15) share together one or more knitted courses, on respective different needle sections, or wherein said first counter-area (20) and said second counter-area (25) share together one or more knitted courses, on respective different needle sections.

14. The process according to claim 1, wherein said step of programming said knitting machine comprises the step of defining, on a given knitted course, or several knitted courses, in intermediate position between the first end or the second end and said turning position, a further turning position in which the tubular intarsia knitted item is configured to be further turned at least partially over itself, so as to define a third fabric at least partially overlapping the first or the second fabric, in order to obtain a triple fabric item.

15. The process according to claim 1, comprising a step of folding said second fabric (6), in said turning position (4), on the first fabric (5), so that the item is a double fabric item and represents a shoe upper (50) developing between a front edge (51), in which the first end (2) and the second end (3) of the tubular intarsia knitted item (1) overlap, and a rear edge (52), corresponding to said turning position (4), wherein said front edge (51) is configured for being closed so as to represent the toe of the upper and of the shoe thereof, and said rear edge (52) is designed to receive the user's foot inserted into it, and wherein the step of folding said second fabric (6) on the first fabric (5) comprises a manipulating step of the tubular intarsia knitted item (1) that causes the insertion of the first fabric (5) into the second fabric (6), the second fabric overlapping the first fabric, so that as a result the inner sides (8A, 8B) of the first fabric (5) and of the second fabric (6), as manufactured by the knitting machine in the tubular item (1), face each other in contact inside the double fabric item (100), and the outer side (7B) of the second fabric (6), as manufactured by the knitting machine, is visible outside the double fabric item (100) and the outer side (7A) of the first fabric (5), as manufactured by the knitting machine, represents the inside of the double fabric item; or vice versa.

16. The process according to claim 1, wherein in said step of arranging a circular weft knitting machine for intarsia design, said knitting machine has the following technical features:

plurality of feeds;

selection of sinkers for each feed;

possibility of manufacturing terrycloth knitted fabric, in each feed and for each needle, both in the forward movement and in the backward movement of the needle-holding organ, and wherein each feed delivers at least one respective yarn, in a given color and/or material, irrespective of the respective yarns of the remaining feeds, and wherein each feed has a plurality of yarn feeders, so that it delivers a plurality of different yarns.

17. A shoe upper (50) manufactured with a tubular intarsia knitted item (1) obtained with a process according to claim 1, wherein said second fabric (6) of the tubular intarsia knitted item is folded, in said turning position (4), on the first fabric (5) of the tubular intarsia knitted item, so that the shoe upper (50) is double fabric and develops between a front edge (51), in which the first end (2) and the second end (3) of the tubular intarsia knitted item (1) overlap, and a rear edge (52), corresponding to said turning position (4), wherein said front edge (51) is configured for being closed so as to represent the toe of the upper (50) and of the shoe thereof, and said rear edge (52) is designed to receive the user's foot inserted into it, said first fabric (5) comprising said at least one first area (10) according to a first knitted structure.

18. The process according to claim 8, wherein the first counter-area (20) corresponds to the whole second fabric (6).

19. The process according to claim 9, wherein said shoe tongue comprises the shoe fabric stripe placed under the laces.

20. The process according to claim 12, wherein said turning position (4) corresponds to a circular knitted course.

* * * * *